US011812220B2

(12) United States Patent
Nobile et al.

(10) Patent No.: US 11,812,220 B2
(45) Date of Patent: Nov. 7, 2023

(54) OMNIDIRECTIONAL SOUND SOURCE

(71) Applicants: Matthew A. Nobile, Poughkeepsie, NY (US); Bryan Janisch, Salem, MA (US)

(72) Inventors: Matthew A. Nobile, Poughkeepsie, NY (US); Bryan Janisch, Salem, MA (US)

( * ) Notice: Subject to any disclaimer, the term of this patent is extended or adjusted under 35 U.S.C. 154(b) by 0 days.

(21) Appl. No.: 17/559,102

(22) Filed: Dec. 22, 2021

(65) Prior Publication Data

US 2023/0199374 A1 Jun. 22, 2023

(51) Int. Cl.
*H04R 1/34* (2006.01)
*H04R 1/28* (2006.01)
*H04R 7/12* (2006.01)

(52) U.S. Cl.
CPC ..... *H04R 1/345* (2013.01); *H04R 1/288* (2013.01); *H04R 7/12* (2013.01)

(58) Field of Classification Search
None
See application file for complete search history.

(56) References Cited

U.S. PATENT DOCUMENTS 3,435,910 A * 4/1969 Lahti ..... H04R 1/24 181/152
2017/0173862 A1* 6/2017 Lin ..... C08J 9/0066

OTHER PUBLICATIONS

"A Test System for Free-Field Qualifications on Anechoic Chambers," by Van B. Biesel et al., Georgia Institute of Technology, Atlanta, Georgia, Sound and Vibration/May 2003, pp. 22-28.

OmniPower Sound Source | B&K Type 4292 | Brüel & Kjaer, found: https://www.bksv.com/en/transducers/acoustic/sound-sources/omni-power . . . Nov. 30, 2021, 5 pages.

NOISE-CON 2007, "Effect of source directionality on deviations from inverse square law in a hemi-anechoic chamber typically used for product noise emission testing," by Ankit Chadha et al., Oct. 22-24, 2007, 11 Pages.

"Anechoic chamber qualification: Traverse method, inverse square law analysis method, and nature of test signal," by Kenneth A. Cunefare et al., JASA, The Journal of the Acoustical Society of America 113, Feb. 2003, pp. 881-892.

US Patent for Methods for producing acoustic sources Patent (Patent # 7 . . . https://patents.justia.com/patent/7610810, Jan. 10, 2008, Ets-Lindgren, 8 pages, found: Nov. 30, 2021.

Noise/News International, A quarterly newsmagazine, vol. 1, No. 1, Mar. 1993, 60 pages.

(Continued)

*Primary Examiner* — Walter F Briney, III
(74) *Attorney, Agent, or Firm* — Saile Ackerman LLC; Stephen B. Ackerman

(57) ABSTRACT

An omnidirectional sound source is formed by mounting a loudspeaker in an enclosed baffle, preferably formed as a low profile hemi-spherical, convex cap with a small circular orifice at its apex and a planar base. The loudspeaker is mounted within the baffle, affixed to the underside of the baffle cap directly beneath the orifice. Substantially plane audio-frequency wavefronts emanating from the immediate vicinity of the loudspeaker diaphragm pass through the orifice and, by the process of diffraction emerge as spherical waves. The spherical wavefronts follow the smooth, axi-symmetric, gently curved contour of the low-profile, hemi-spherical baffle and are not distorted by edge effects where the baffle joins its planar base. As a result, an omnidirectional sound source is obtained.

16 Claims, 3 Drawing Sheets

(56) References Cited

OTHER PUBLICATIONS

NOISE-CON 90, The University of Texas, Austin, Texas, Oct. 15-17, 1990, "Draw-Away Testing for Qualification of Hemi-Anechoic Rooms," by George C. Maling, Jr et al., pp. 363-368.
Dodecahedron loudspeaker Nor276 | Norsonic, Found: https://web2.norsonic.com/product_single/dodecahedron-loudspeaker-no . . . , Nov. 30, 2021, pp. 1-7.
Reno, Nevada, NOISE-CON 2007, Oct. 22-24, 2007, "Source design considerations for qualifying hemi-anechoic chambers in compliance with ISO 3745," by Douglas Winker et al., 11 pages.

* cited by examiner

OBLATE SPHERE

OMNIDIRECTIONAL SOUND SOURCE

BACKGROUND

1. Technical Field

This disclosure relates generally to a source of sound, specifically to such a source that radiates omnidirectionally.

2. Background

There are many types of acoustical measurements that require a sound source that radiates sound equally or nearly equally in all directions. Such a source is termed an omnidirectional source. One example for the need of such a source is when acoustical measurements are taken to "qualify" a special test room or environment, such as an anechoic or hemi-anechoic chamber. Because such chambers are generally costly to manufacture and install, the purchaser generally needs reassurance that the chamber itself meets its specifications. International standards define the methods for qualifying such chambers and specify the pass-fail criteria. Essentially the qualification procedure proceeds as follows.

1. A special sound source is located in the center of the chamber and various test signals are generated and reproduced by the sound source.
2. Sound pressure-level measurements are made at incremental points along several linear "traverses" from the sound source towards the chamber walls.
3. The drop-off of sound level versus distance along the traverses must meet certain criteria based on the theory of sound radiation in a "free field", which the anechoic chamber is attempting to simulate.

The relevance of the above procedural steps to the present disclosure is that the steps are predicated on the assumption that all of the surfaces of the chamber are irradiated equally by the test signals from the sound source in short, the sound source must be essentially "omnidirectional".

Another example of the role of sound sources that is particularly relevant to the present disclosure is the measurement of the reverberation time and other acoustical parameters of a concert hall or auditorium, Here, again, the test signals from the sound source, which may be placed on the stage or in the center of the hall, must radiate equally to all the surfaces of the hall or whatever acoustical space is being tested.

There have been attempts to create loudspeakers that are omnidirectional in their sound patterns, but these attempts have generally been unsuccessful. For example, an array of loudspeakers arranged on the surface of a solid and pointing outward in different directions, e.g., a dodecahedron for radiation into a full space or a hemi-dodecahedron for radiating into a half space. These arrangements are subject to interference effects and generally produce unsatisfactory results.

SUMMARY

A primary problem that presently exists in implementing certain acoustical test standards, such as (but not limited to) those discussed briefly above, is to create a sound source that is omnidirectional, i.e., that radiates sound equally (and uniformly) in all directions. The familiar loudspeakers available on the market, even the most expensive audiophile models (i.e., loudspeakers for "Hi-Fi" sound reproduction) do not and cannot achieve and provide these qualities. In fact, they would be very poor candidates for meeting these requirements and standards.

A secondary (though hardly less important) problem is to create a single source that is omnidirectional over the entire frequency range required by the measurement standards being implemented.

Certain sound sources may be relatively omnidirectional, but only over a limited frequency range. Using limited frequency ranges would require the use of multiple sources to conduct repeated tests in order to complete the measurements successfully, greatly increasing test time.

Finally, a third problem is creating a sound source that is not only omnidirectional, but that also has sufficient amplitude (loudness), especially at the higher frequencies, so that the measured levels far from the source still meet the signal-to-noise criteria of the standards.

It shall therefore be the following objects of the present disclosure:

1. To provide an omnidirectional sound source.
2. To provide such a source that is uniformly directional within a wide range of frequencies.
3. To provide such a source that is also of sufficient amplitude and will meet appropriate signal-to-noise standards across a range of frequencies that are appropriate to the measurements being made.

The present disclosure overcomes all three of the above problems. It is packaged as a single acoustical source that covers the entire frequency range of the measurements being considered (e.g., 100-10,000 Hz) with sufficient sound level and an omnidirectional radiation pattern.

These and other objectives are achieved by an omnidirectional sound source constructed as follows. A low-profile baffle is formed as a bounded, axi-symmetrical, downward-curving convex "cap" or dome (imagined sectioned off the top of a much larger sphere, hemisphere, oblate sphere or similar shape so as to provide low-profile curvature) with an orifice located at its apex. The section may be taken from a hollowed-out shell or it may be taken from solid slice and then hollowed out. This curved baffle will ultimately be mounted to a flat-bottomed plate beneath it, the plate being affixed and sealed to the baffle along its periphery, thereby forming an enclosed, hollow volume.

Before mounting the baffle to the flat-bottomed plate to form an enclosure, an audio-frequency loudspeaker is mounted to the underside of the curved baffle, via a mounting ring or plate. The loudspeaker is symmetrically positioned beneath the orifice and extends at least to the edge of the orifice, thereby being configured for directing sound waves at the orifice and through the orifice.

The loudspeaker is sealed to the mounting ring or plate, which in turn is sealed along its perimeter to the underside of the baffle, thereby ensuring that the sound waves emanating from the front of the loudspeaker are radiated exclusively through the orifice.

The volume of the enclosure below the loudspeaker and mounting ring or plate is filled with sound-absorbing material to effectively absorb any sound radiating from the rear of the loudspeaker.

The curved baffle is treated with either an internal damping material (e.g., a "damped metal" or "constrained layer damping") or an attached damping material (e.g., "extensional damping") to limit its vibration. The loudspeaker mounting ring or plate may also be "vibration-isolated" along its periphery from the curved baffle to further limit the vibration of the baffle. Note that the sound absorbing material inside the enclosure beneath the loudspeaker also tends to eliminate potential vibration of the baffle.

DETAILED DESCRIPTION

Figure 1:
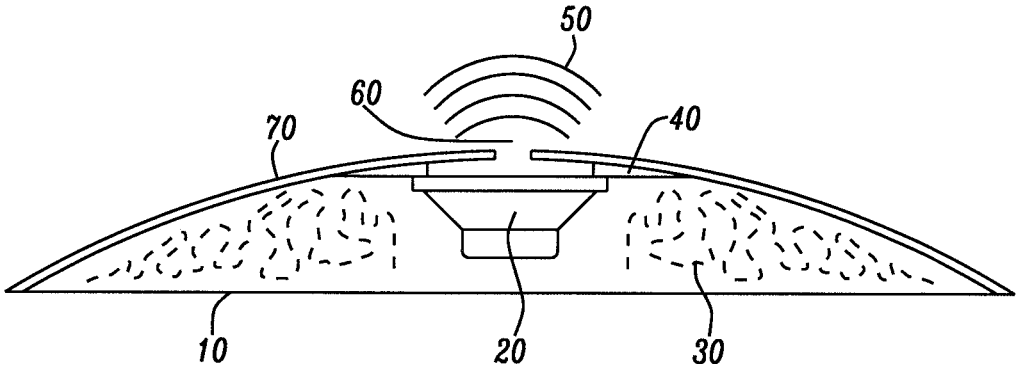
FIG. 1 is a schematic illustration of the omnidirectional sound source configured to be placed on a floor.

This disclosure provides a special sound source, an "omnidirectional" sound source, that radiates sound in an omnidirectional pattern (the level of sound at a given distance from the source is constant over all angles) over a wide frequency range (e.g., 100 Hz-10 kHz).

The sound source does this through the use of a loudspeaker mounted in a compact enclosure, the design of which achieves the desired omnidirectional radiation pattern over the full frequency range. The disclosure is for a special sound source primarily intended for acoustical test applications, but which also will be useful in other applications.

The disclosure describes a special loudspeaker enclosure that radiates sound in an omnidirectional pattern over a wide frequency range (e.g., 100 Hz-10 kHz). The ability of the system to meet the objects discussed above is a result of two elements (features) of the enclosure itself.

First, the sound from the loudspeaker is constrained to radiate through a small, circular orifice at the apex of the otherwise sealed enclosure where, through the process of diffraction, it emerges in an essentially spherical sound wave (i.e., acoustical wave) pattern.

Second, the shape of the enclosure and particularly its low-profile are such as to allow a very smooth transition of the acoustical wavefronts emerging from the orifice and travelling along the outer surface of the enclosure (the curved "baffle") to the floor on which the enclosure is placed. The contact between the cap and the floor must not be too abrupt lest it give rise to edge diffraction effects which would adversely affect the desired omnidirectionality. A shape of the baffle in a preferred embodiment is that of a "spherical cap"; i.e., a small section or "dome" that can be imagined as cut from the top of a sphere (i.e., from a horizontal slice through a circle of latitude). This is illustrated in schematic FIG. 1.

Generally, the radius of the hypothetical underlying sphere, from which the "cap" would be cut, is much larger than the height of the cap, resulting in a very "shallow" cap from apex to base. For the sake of illustration, imagine the cap or dome resting on the floor, then the height of the cap might be only 75 mm from base to apex while the diameter of the circular bottom (that is in contact with the floor) might be 200 mm. These dimensions are actually those of one embodiment that was fabricated and tested.

The small, circular orifice, for example, having a diameter of about 12 mm in the aforementioned embodiment of the present disclosure, is located at the apex of the dome, and the loudspeaker is mounted directly beneath the orifice and affixed to the underside of the baffle, by means of a mounting ring. When the baffle is subsequently affixed at its bottom periphery to a flat plate, a sealed enclosure is formed in which the loudspeaker is completely contained.

Other necessary and typical components of the loudspeaker assembly—mounting rings, fiberglass fill (the acoustic absorbing material), wiring, filters, etc.—are located within the enclosure.

Referring first to FIG. 1, there is shown a schematic illustration of the components of the system that will satisfy the objects listed above. FIG. 1 as well as the text associated with the descriptions of the system depicts a sound source that is intended to be placed on a floor or similar rigid, hard, flat surface. However, as shown schematically in FIG. 6, the system can also be mounted overhead in an inverted configuration as in the ceiling of a car if it is meant to test the sound qualities of the car interior or if it is meant to be a permanent fixture of the car, i.e., a Bluetooth speaker as shown schematically in FIG. 6.

As indicated in FIG. 1, the schematic structure of the system shows a convex baffle 70, which creates and supports an omnidirectional sound wave pattern. This unique axisymmetric downward curved convex shape and low profile allows sound waves radiating from an orifice 60 to smoothly transition along its curved surface to the floor (not shown) or flat surface on which the system is typically placed, without causing any abrupt transitions at the edge of the baffle (where it meets the floor) that could cause disruptive diffraction effects and diminish the omnidirectionality of the acoustic radiation.

At the apex of the baffle a small orifice 60, circular in this embodiment, has been created in the baffle. A loudspeaker 20 in close proximity to the orifice, generates essentially plane waves (not shown) of sound which are forced through the orifice and, through the process of diffraction, emerge as spherically spreading wavefronts 50. Due to the low-profile and special shape 70 of the baffle, these wavefronts maintain their spherical nature as they spread out along the baffle surface and along the extended floor or other flat surface 10 on which the baffle is positioned. In essence, the unique baffle and orifice transform the sound from the speaker into a spherical wave with the orifice at its center. The resulting sound field in the room or space is essentially omnidirectional.

A mounting ring (or sealing ring) 40 allows the loudspeaker to be mounted and sealed to the undersurface of the baffle in close proximity to the orifice 60 so that all of the sound emanating from the front of the loudspeaker is forced through the orifice and the rearward radiated sound waves are isolated from the forward radiated sound waves leaving the orifice. Note, the loudspeaker may be a simple version using a conical driver as a vibrating diaphragm and a permanent magnet and coil to produce audio frequency vibrations of the diaphragm. Other, more sophisticated acoustical drivers may also be suitable.

Acoustical absorptive material 30 filling the baffle absorb the "back waves" from the loudspeaker 20 and prevents an undesirable buildup of sound within the structure. A bottom plate 10 seals the internal volume of the enclosure and prevents the leakage of acoustical energy from the bottom.

The top surface of the baffle can be damped by covering it externally and/or internally (not shown) with a layer of damping material to prevent or minimize vibrations. Finally, a crossover network or filter system can be added to smooth, shape or optimize the response of the loudspeaker radiation emanating from the orifice.

Figure 2:
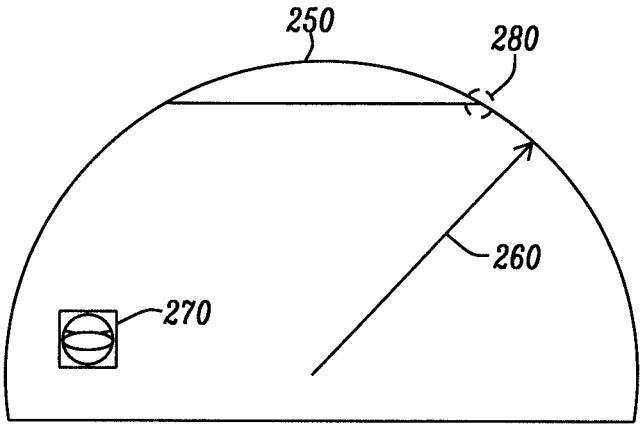
FIG. 2 is a schematic illustration showing how the omnidirectional sound source comprises an enclosure baffle in the shape of a spherical cap taken from a much larger hollow sphere.
Figure 10:
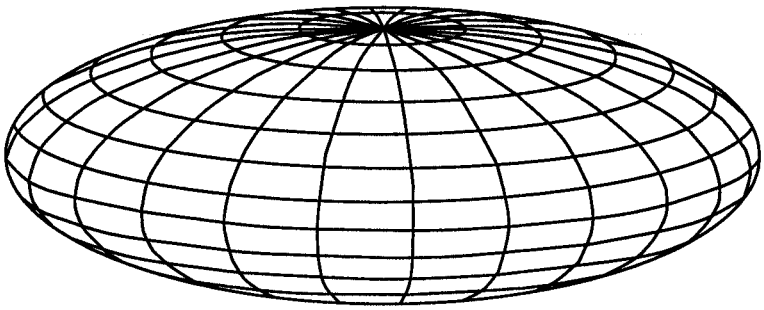
FIG. 10 is a schematic illustration of an oblate spheroid whose shape would also provide a low-profile, smoothly downward curving cap (horizontal slice of latitude) with which to form the presently described baffle.

Referring next to FIG. 2, there is shown a schematic illustration of a portion of a hypothetical sphere of radius R, 260, from which a cap 250 is hypothetically sliced to define the baffle surface. Note that the hypothetical sphere could be a hollow spherical shell or a solid sphere but it will ultimately be processed to form form a hollow baffle. A small inset, 270 is for the purpose of showing the illustration in a small 3-dimensional view, showing the equatorial line of the sphere as extending well beyond the smaller cap. This design facilitates the low-profile aspect to the curved baffle which is essential to preventing edge diffraction effects and maintaining the spherical nature of the sound field. Note that although the illustration shows a true sphere, the cap or dome of this disclosure could also have been extracted from the top of an oblate spheroid (a "squished" sphere) as shown in FIG. 10. Further note that the illustrations are for the purpose of elucidating the shape of the curved baffle and, in practice, the shape may be obtained from any appropriate fabrication process and need not be extracted from an existing larger sphere or oblate spheroid. It is also noted that the baffle is generally uniform in thickness but may, in special circumstances, have a non-uniform thickness if, for example, strengthening of the baffle is required at various positions and regions of attachment.

The surface of the cap should be smooth, curved and of low-profile for the reasons discussed above. In addition, the curved surface of the baffle should meet the horizontal surface of the floor (or other flat surface on which the baffle is placed 280) smoothly, so as to mitigate the edge diffraction effects that an overly abrupt transition would cause.

Figure 3:
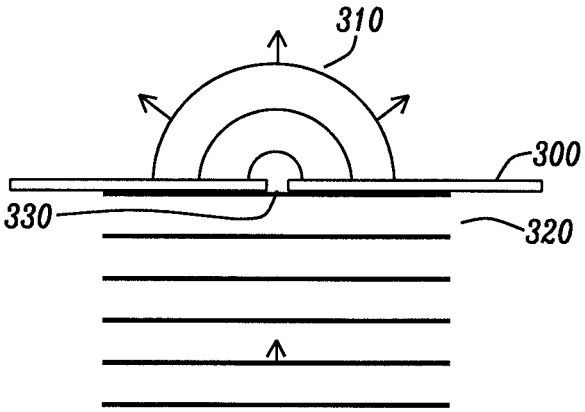
FIG. 3 is a schematic illustration of wave diffraction of a plane wave through a small orifice. The wave fronts are incident on a relatively planar boundary (i.e., a baffle) with a small hole (orifice) in it.

Referring now to FIG. 3 there is shown a schematic illustration illustrating the principle of "wave diffraction," (or, Huygen's principle) which occurs when only a small part of a series of unidirectionally propagating wavefronts of a planar wave 320 pass through a small orifice (i.e., the dimensions of the orifice 330 are small in comparison to the wavelength of the sound under consideration) in a plate 300. By blocking the passage of an entire unidirectional wavefront produced by the loudspeaker, what comes through the orifice is semi-spherical and omnidirectional (or more strictly, hemispherical in the space above the plate 300).

In order for this principle to work fully, the baffle would have to be infinitely extensive beyond the periphery of the orifice. If this were not the case the portion of the emerging wave would reach the edges of the baffle (or a "corner" if the baffle were a box) and be distorted in shape. This distortion, called "edge diffraction" would distort the spherical wavefronts of the diffracted waves emerging from the orifice and the omnidirectionality would be destroyed or seriously degraded.

In the system disclosed herein, the loudspeaker is effectively generating plane waves of sound (plane, relative to the size of the orifice) that are then forced through the orifice. Spherical diffracted wavefronts are then emergent from the orifice and they remain approximately spherical as they spread out and propagate along the contoured surface of the baffle. The contoured surface, along with its low profile, eliminates any discontinuities at the edges of the baffle that would cause disruptive edge diffraction and thereby allows the emerging waves to retain their omnidirectional pattern. The sealed enclosure itself prevents any back wave from the loudspeaker (waves initially going away from the orifice) from coming around from the back of the loudspeaker and subsequently interfering with the sound from the orifice. The effect of this back wave is further eliminated by the absorptive material (e.g., fiberglass, acoustical foam) in the enclosure which absorbs acoustical energy in the back wave.

Figure 4:
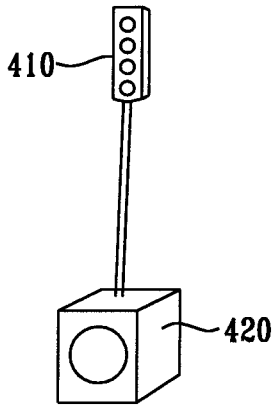
FIG. 4 is a schematic illustration showing a prior art configuration of a low frequency box (a "woofer") with a vertical line array of several small high frequency "tweeters" above it. This arrangement creates a directional radiation pattern of the high frequencies and the pattern also shows interferences between the tweeters and "notches" in the pattern. The resulting sound field is far from omnidirectional.

Referring to FIG. 4 there is shown an example of a prior art speaker design that is meant to produce an approximation to omnidirectionality. It shows a linear arrangement 410 of small mid-range or high-frequency speakers (tweeters) mounted above a low frequency speaker (a woofer 420). Unfortunately, the linear configuration of tweeters is still directional in its sound propagation and also subject to edge-diffraction effects and sound source interferences due to the presence of multiple speakers, producing notches (drop-outs and loudness variations) in the frequency distribution.

Figure 5:
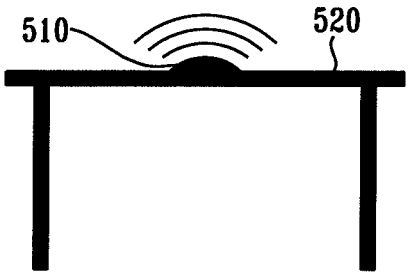
FIG. 5 is a schematic illustration of the disclosed omnidirectional sound source being used in a conference room in a tabletop configuration where it offers participants seated around the table a uniform sound field.

Referring to FIG. 5 there is shown an example of the present design 510 mounted in a conference table 520 for use in an audio communication system. The omnidirectional distribution of sound is ideal for ensuring that all participants can hear the sound emanating from the central speaker with equal loudness and clarity.

Figure 6:
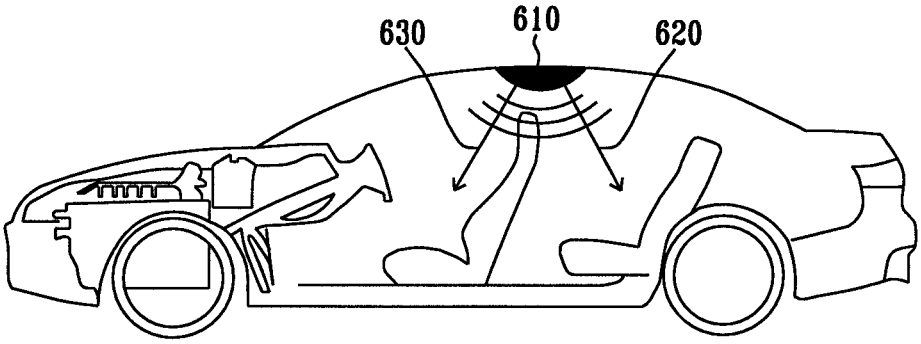
FIG. 6 is a schematic illustration of the omnidirectional sound source being placed in the ceiling of a car, e.g. as a Bluetooth speaker, where it will provide all the occupants a uniform sound experience.

Referring to FIG. 6 there is shown a version of the present system mounted in the ceiling of a car 610. In this position it can be used to conduct acoustical analyses of the car's interior (e.g., by the manufacturer or an aftermarket provider) or it can be provided as a fixture in the car to enhance the audio system or to provide a Bluetooth speaker for the seated occupants 620, 630 of the car.

Figure 7:
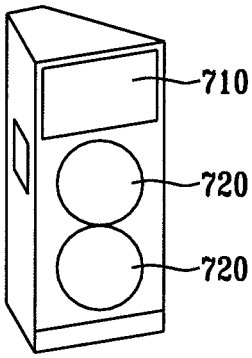
FIG. 7 is a schematic illustration of a fairly common high-end audio system comprising two forward facing woofers and a single horn mid-range/high frequency driver. The horn is still directional and the higher frequencies will not be heard at the sides.
Figure 8:
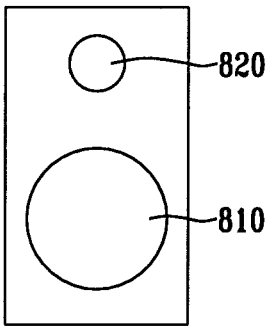
FIG. 8 is a schematic illustration of a common configuration in which the woofer and tweeter are both circular drivers. Off-axis frequency response suffers as a result of the directional pattern of the tweeter.

FIGS. 7 and 8 show prior art audio systems that do not provide omnidirectional sound. FIG. 7 shows a typical three-way speaker with a mid-range horn 710 and two woofers 720 that is intended to spread the sound out to the audience. A problem is that the horn 710 is still significantly directional and the important high-frequencies still fail to radiate at all to the sides of the speaker.

FIG. 8 shows a typical two-way hi-fi speaker system with a single woofer 810 and a single mid/high frequency driver 820. Again, the use of a directional high-frequency driver (tweeter), coupled with the severe edge-diffraction effects of the corners of the box enclosure, cause the important high-frequencies to be very directional and corrupted by interference effects.

Figure 9:
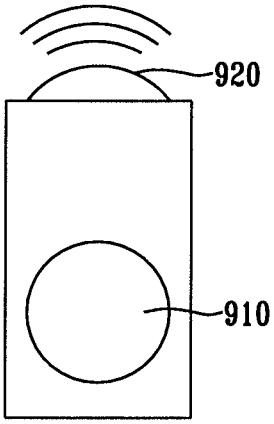
FIG. 9 is a schematic illustration showing how the present omnidirectional design would be mounted on top of a woofer and used to replace a typical horn driver (see FIG. 7) in a PA system or serve as a speaker for a hi-fi system.

FIG. 9 shows, schematically, how the presently disclosed design 920 would be placed above an enclosed woofer 910 and replace the horn driver (710 in FIG. 7) in a typical PA system or the high-frequency driver (820 in FIG. 8) in a typical stereo hi-fi system (or in similar audio applications) to render them omnidirectional and eliminate edge-diffraction interferences.

The presently disclosed sound source may also have applications such as the following, all of which generally require (or benefit from) a relatively omnidirectional source of sound.

1) Measurement of the reverberation times in auditoria, concert halls, or other spaces used for musical performances during the design and qualification of the space.
2) Measurement of the reverberation times in special test rooms used for acoustical measurements, such as Reverberations Rooms.
3) Use as a mid- and high-frequency speaker in a Public Address (PA) system. For instance (see FIG. 9), the spherical cap can be located on top of a "tower" PA speaker, the tower containing the low frequency (bass/woofer) part of the PA system. This would allow the voice frequencies to spread out omnidirectionally to the audience, something that is difficult to accomplish with current PA's.
4) As in 3) above, but the use would be in a typical home stereo system where the "tweeter" would be contained in the disclosed omnidirectional sound source and sit atop a tower loudspeaker.

The description of the loudspeaker indicates a method by which it may be fabricated. Keys to the performance of the baffle are its smooth low-profile and the gradual curvature and lack of an abrupt confluence with the flat surface on which it is to be mounted. Of course, consideration should be given to the degree of portability desired in the completed unit, which could place limits on the materials to be used in the construction.

The particular construction material chosen might dictate the basic methods needed to create the smooth, low-profile shape of the baffle. The baffle cap can be 3D printed, molded, carved from a solid, heat-formed or constructed of separate segments that are then fastened together smoothly. One example of fabrication is the use of a metal spinning process, using a lathe, and a prefabricated form of the desired size, such as the use of a flat sheet of steel or aluminum pressed against a solid (e.g., wood) form shaped as a hemisphere or a portion thereof. Important factors in the fabrication include the rigidity of the baffle and the importance of the periphery mating flush with the surface upon which it will be placed. This meeting region might be smoothed or tapered to reduce the amount of edge diffraction. It is also to be noted that the curved cap should be generally uniform in thickness, but some degree of non-uniformity might be required to strengthen the cap at regions of its attachment to the flat plate that serves as its base.

As is finally understood by a person skilled in the art, the detailed description given above is illustrative of the present disclosure rather than limiting of the present disclosure. Revisions and modifications may be made to methods, materials, structures and dimensions employed in forming and providing an omnidirectional sound source configured for omnidirectional sound creation and propagation, while still providing such a system and its method of formation in accord with the spirit and scope of the present disclosure as defined by the appended claims.

We claim:

1. An omnidirectional sound source comprising:

a low-profile baffle having an apex, an outer surface of shallow aspect ratio tapering away from said apex, an axisymmetrical, downward-curved convex shape of generally uniform thickness and a bounded periphery;

an orifice located at said apex of said baffle, said orifice having an opening that is smaller than or comparable to wavelengths of audio-frequency sound (e.g. 100-10,000 Hz) and is thereby shaped to diffract planar sound waves impinging thereon and passing therethrough and to produce transmitted sound waves that are diffracted in accord with Huygen's principle and will propagate said waves omnidirectionally and of uniform intensity while guided by said surface shape of said baffle; and an audio-frequency loudspeaker mounted to an underside of said baffle, positioned beneath said orifice, producing planar said sound waves directed at said orifice and impinging thereon and diffracted thereby and said loudspeaker having a periphery that extends at least to the periphery of said orifice and a flat, bottom-plate mounted fixedly beneath and to said low-profile baffle and positioned to ensure that said baffle has no regions of abrupt curvature and/or edge diffraction along said bounded periphery, thereby maintaining said omnidirectionality.

2. He omnidirectional sound source of claim 1 wherein said flat bottom-plate is formed beneath said baffle and mounted, without producing any abrupt curvature, to said baffle along its periphery, whereby said baffle, said audio-frequency loudspeaker and said flat bottom plate form an enclosed volume of low profile and without any abrupt surface curvature that produces edge diffraction of emitted sound waves diffracted by said orifice and destroying said omnidirectionality; and wherein omnidirectionality of diffracted sound waves is thereby created and maintained; and wherein sound-absorbing material has been placed within said enclosed volume beneath said loudspeaker.

3. The omnidirectional sound source of claim 2 wherein said baffle is of uniform or generally uniform thickness but may be non-uniform if it is desired to strengthen the cap structurally at regions of attachment to said flat bottom plate.

4. The omnidirectional sound source of claim 2 wherein a mounting ring or plate is affixed between said audio-frequency loudspeaker and an underside of said baffle, said mounting ring or plate thereby facilitating an installation of said loudspeaker at a distance between said loudspeaker and said orifice whereby forward directed sound radiation directed at said orifice and diffracted thereby is completely isolated from any rearward directed sound radiation directed away from said orifice.

5. The omnidirectional sound source of claim 2 wherein sound waves of wavelengths greater than or comparable to said opening of said orifice produced by said loudspeaker pass through said orifice and, by a process of diffraction in accord with Huygen's principle, thereby form spherical waves whose wavefronts propagate uniformly, undistorted, guided outward along said low-profile outer surface of said baffle, wherein;

said outer surface of said baffle is shaped so that an intersection at an attachment with said flat bottom plate is smooth and without abruptness; wherein as a result of said shape and said low-profile outer surface of said baffle, edge diffraction effects at the periphery of said baffle's intersection with said flat bottom plate are mitigated and omnidirectional diffracted waves are created and propagate in a space above said baffle surface.

6. The omnidirectional sound source of claim 2 wherein said sound absorbing material is a fiberglass fiber and is used to partially absorb a back wave within said enclosed baffle.

7. The omnidirectional sound source of claim 2 wherein said sound absorbing material is an acoustical foam and is used to partially absorb a back wave within said enclosed baffle.

8. The omnidirectional sound source of claim 1 wherein said baffle is covered by layers of vibration damping material to reduce or eliminate vibrations of the baffle.

9. The omnidirectional sound source of claim 1 wherein said convex surface is in the form of a hemispherical surface cap formed by a hypothetical horizontal slice through the surface of a large sphere along a surface of latitude thereby forming a low-profile curved baffle as is measured by a shallow, (height to width), aspect ratio.

10. The omnidirectional sound source of claim 9 wherein said orifice is a diffracting circular opening formed at the apex of said hemispherical surface cap.

11. The omnidirectional sound source of claim 10 wherein said apex of said cap is of a height of 75 mm above its circular base and the radius of its circular base is 200 mm and the corresponding aspect ratio is said height divided by said diameter of said circular base and will propagate diffracted sound waves omnidirectionally along said cap.

12. The omnidirectional sound source of claim 10 wherein said orifice is a circular opening of radius 6 mm from the apex of its hemispherical surface cap.

13. The omnidirectional sound source of claim 1 wherein said convex surface is in the form of an oblate-spherical surface cap formed by a hypothetical horizontal slice through the surface of a large oblate sphere along a circle of latitude, thereby forming a low-profile curved baffle.

14. A method of forming an omnidirectional sound source comprising:

providing a low-profile baffle having an axisymmetrical, smooth, downward-curved convex shape of uniform thickness and a bounded periphery;

forming a circular orifice at an apex of said baffle, said orifice diffracting planar sound waves of wavelength greater than the dimension of said circular orifice passing therethrough and producing sound waves that are diffracted, omnidirectional and of uniform sound intensity;

mounting an audio-frequency loudspeaker to an underside of said baffle, beneath said orifice, directed at said orifice and having a periphery that extends at least to the periphery of said orifice;

mounting said baffle smoothly to a flat bottom plate, producing, thereby, a low-profile surface shape as measured by aspect ratio of said baffle and with no regions of abrupt curvature, having first filled space between said baffle and said flat plate with sound damping material as well as any electronic circuitry required to operate said loudspeaker.

15. The method of claim 14 wherein said baffle is formed of any of a number of rigid materials that can be shaped to a shell-like form by methods including molding, 3D printing, carving out, heat-forming or fastening together separate shaped sections or segments, thereby producing a low-profile smooth shape equivalent to that of a cap produced by a slice of a hollow sphere or oblate sphere or downward curving axisymmetric shape.

16. The method of claim 14 wherein said baffle is mounted smoothly to said flat plate by eliminating an abrupt curvature where a point of contact occurs.

* * * * *